US008337374B2

(12) United States Patent
Garthaffner et al.

(10) Patent No.: US 8,337,374 B2
(45) Date of Patent: Dec. 25, 2012

(54) METHOD AND APPARATUS FOR PRODUCING COMPOSITE CIGARETTE FILTERS

(75) Inventors: Martin T. Garthaffner, Chesterfield, VA (US); Ahmet Ercelebi, Mechanicsville, VA (US); James D. Evans, Chesterfield, VA (US); Jeremy Straight, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 2171 days.

(21) Appl. No.: 11/156,276

(22) Filed: Jun. 17, 2005

(65) Prior Publication Data

US 2005/0282693 A1 Dec. 22, 2005

Related U.S. Application Data

(60) Provisional application No. 60/581,486, filed on Jun. 21, 2004.

(51) Int. Cl.
*B65B 19/04* (2006.01)
*B31C 99/00* (2009.01)

(52) U.S. Cl. ..... 493/39; 53/444; 53/148

(58) Field of Classification Search ..... 493/50, 493/39; 53/444, 148

See application file for complete search history.

(56) References Cited

U.S. PATENT DOCUMENTS

| | | | | | |
|---|---|---|---|---|---|
| 3,570,557 | A * | 3/1971 | Molins | 141/99 |
| 3,844,200 | A * | 10/1974 | Sexstone | 493/45 |
| 3,922,837 | A * | 12/1975 | David | 53/234 |
| 3,948,115 | A * | 4/1976 | Seragnoli | 74/421 R |
| 4,238,994 | A | 12/1980 | Koch | |
| 5,887,595 | A | 3/1999 | Draghetti et al. | |
| 6,141,943 | A * | 11/2000 | Hart et al. | 53/444 |
| 6,264,591 | B1 | 7/2001 | Keen et al. | |
| 2004/0107973 | A1 * | 6/2004 | Atwell | 131/342 |

* cited by examiner

*Primary Examiner* — Lindsay Low
*Assistant Examiner* — John Paradiso
(74) *Attorney, Agent, or Firm* — Connolly Bove Lodge & Hutz LLP

(57) ABSTRACT

Method and apparatus for producing discrete filter rods includes a first conveyor for transporting filter segments of given length in a downstream direction. Three counter rotating transfer wheels receive the filter segments between spaced apart cleats on the circumference of the wheels. The first wheel receives the filter segments from the first conveyor and transfers the segments to the second wheel which in turn transfers the segments to the third wheel. Filter segments between the cleats on the third wheel are deposited upon a second conveyor with plug wrap thereon in precisely spaced apart relationship. Granular adsorbent material is filled into cavities between the filter segments, and a garniture folds the plug wrap around the filter segments and the filled cavities therebetween.

11 Claims, 3 Drawing Sheets

METHOD AND APPARATUS FOR PRODUCING COMPOSITE CIGARETTE FILTERS

CROSS REFERENCE TO RELATED APPLICATIONS

The present application claims the benefit of U.S. Provisional Application Ser. No. 60/581,486, filed Jun. 21, 2004, in its entirety for all useful purposes.

BACKGROUND OF THE INVENTION

The present invention relates to method and apparatus for producing rods comprising multiple segments and finds particular application in the manufacture of combined filters or recess filters for cigarettes.

Cigarettes typically comprise a wrapped tobacco column that optionally is tipped with a filter. The filter, in turn, may optionally be a composite filter comprising a plurality of (possibly dissimilar) filter rod segments. The dissimilar filter rod segments making up the composite filter may, for example, include different base filter materials or may comprise the same base filter material, but with alternate segments being impregnated with a particulate material such as carbon particles. Alternatively, the filter may comprise spaced apart filter material segments with fillable cavities therebetween for receiving adsorbent particles such as carbon granules, for example. Still another alternative is that the cavities not be filled and the filter rod be cut into so-called recess cigarette filters. By way of example, FIG. 1 shows a composite filter rod 10 comprising alternating segments or plugs of cellulose acetate tow 12 defining cavities 14 between the tow segments and the cavities being filled with granular adsorbent 16.

Composite filters comprising a plurality of filter rod segments together with one or more unfilled cavities can be cut into recess filters.

In the alternative, the filter rod 10 of FIG. 1 may be centrally cut into two, two-up combined fibers, and subsequently cut centrally at the cellulose acetate tow 12 of each two-up portion to produce four individual (1-up) combined cigarette filters of a filled plug-space-plug configuration.

It is known to manufacture cigarettes having combined or recess filters using a two-stage double-wrap process. In the first stage, a combining device is used to form a continuous stream of spaced apart filter segments which are then partially wrapped in a web of paper (plug wrap) to form a continuous filter rod. The cavities between the filter segments of the partially wrapped continuous filter rod are then filled with granular adsorbent material after which the rod is totally wrapped. The rod is subsequently severed at regular intervals by a cutting mechanism to yield a succession of discrete composite filter rods. In the second stage of the process, after each rod is centrally cut into two, two-up combined filters, a tipping machine is used to join each two-up combined filter to pre-wrapped tobacco columns using tipping paper to form cigarettes.

Typically the discrete composite filter rods produced in the first stage of the double-wrap process are of multiple unit length, that is they contain multiple composite filters each of which is ultimately combined with a tobacco column in order to form a cigarette. For example, after each rod is centrally cut into two, two-up combined filters, each two-up combined filter might contain a centrally located first filter segment of double unit length, flanked by a pair of cavities filled with granular adsorbent and each of unit length. A filter segment of unit length also is on the outside of each filled cavity. In the second stage of the double-wrap process, each two-up combined filter rod would then be joined at either end to a pair of wrapped tobacco columns to form a double unit length cigarette having a double unit length filter at the center thereof. Finally, each double unit length cigarette would be severed at the midpoint of the composite combined filter rod to yield two filter cigarettes of unit length, each having a combined filter containing one of the filled cavities with one-half of a first filter rod segment on each side thereof.

The discrete composite filter rod shown in FIG. 1 when cut into four sections of equal length would produce four combined filters.

The filtration characteristics of composite cigarette filters such as shown in FIG. 1 depend upon the length of the filter segments as well as the spacing therebetween which defines the cavities subsequently filled with granular adsorbent material. In the double-wrap process described above, the precise position of each cut made in the continuous filter rod relative to the plurality of filter rod segments therein is, therefore, extremely important as it determines the length of the outermost or external filter rod segments of the discrete composite filter rods produced.

Known apparatus for the production of composite filters suffers from the disadvantage that the plurality of filter rod segments making up the composite filter, having been assembled into the desired combined filter or recess filter configuration by the combining device, are free to move relative to one another before being wrapped in the web of paper and thereby fixed in position. As a result, the filter rod segments making up the composite filter are not always in the correct position within the continuous filter rod at the point at which it is severed, resulting in the formation of discrete composite filter rods having external filter rod segments of differing length, as illustrated in FIG. 2. In the manufacture of recess filters using such known apparatus, the relative movement of filter rod segments prior to enclosure in the paper web can also give rise to variation in the length of the recesses in the discrete recess filter rods produced. Variations in cavity volume in filled plug-space-plug filter configurations can affect cigarette performance and is undesirable.

Consequently, in such known apparatus, where as a result of relative movement of the filter segments the continuous filter rod is not severed in such a way that the composition of each and every discrete composite filter rod is the same, it is also known to continually monitor the length of the external filter segments of the discrete composite filter rods produced, and in the case of recess filters the length of the air gaps therein, in order to maintain quality standards. If the structure of a discrete composite filter rod is identified as not meeting predetermined criteria (i.e. is "off specification"), the rod is marked as being such and segregated from the remaining satisfactory discrete filter rods prior to introduction into the tipping machine. The generation of waste combined filter rods is, of course, undesirable. In practice, the air gaps in recess filters for cigarettes are typically about 10 mm in length (5 mm when cut), with any variation in the length of the air gap of greater than about ±1 mm resulting in the recess filter being rejected. The same concerns apply to the manufacture of filled plug-space-plug filters.

SUMMARY OF THE INVENTION

In order to overcome the disadvantages associated with known apparatus, it would be desirable to provide apparatus for the production of composite cigarette filters that allows for increased precision during production of the external filter rod segment length of both combined filters and recess filters and/or of the length of the air gaps of recess filters.

It would also be desirable to provide apparatus for the production of composite cigarette filters which enables the machine speed of the apparatus to be increased while maintaining the same level of final composite filter quality.

Furthermore, it would be desirable to provide apparatus for the production of composite cigarette filters that gives rise to less waste during production in terms of defective combined filter rods than known apparatus.

Finally, it would be desirable to produce apparatus for the production of composite cigarette filters that requires less maintenance compared to known apparatus.

In accordance with the present invention there is provided apparatus for producing rods comprising multiple segments including wrapping means for wrapping a continuous sequence of segments in a continuous web of material to form a continuous rod, cutting means for severing the continuous rod into a plurality of discrete rods comprising multiple segments, and combining means for forming the continuous sequence of segments and for transporting the continuous sequence of segments along a path to the wrapping means. The combining means is adapted to substantially prevent relative movement of the segments in the continuous sequence over substantially the entire length of the path to the wrapping means.

According to another aspect of the present invention there is provided a method of producing rods comprising multiple segments including the steps of forming a continuous sequence of segments, transporting the continuous sequence of segments along a path to a first position, wrapping the continuous sequence of segments in a continuous web of material to form a continuous rod at the first position, and severing the continuous rod to produce a plurality of discrete rods comprising multiple segments. The method further comprises maintaining the positioning of the segments in the continuous sequence during the transporting step so as to substantially prevent relative movement of the segments over substantially the entire length of the path to the first position.

BRIEF DESCRIPTION OF THE DRAWINGS

Novel features and advantages of the present invention in addition to those noted above will become apparent from a reading of the following detailed description in conjunction with the accompanying drawings wherein similar reference characters have been used to identify parts and in which.

DETAILED DESCRIPTION OF THE INVENTION

Figure 1:
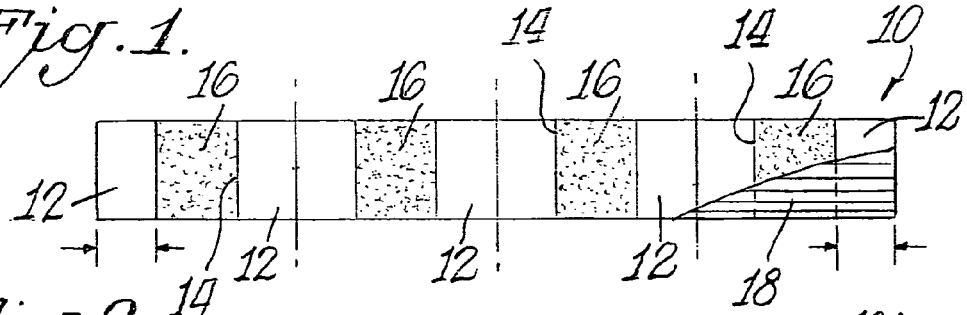
FIG. 1 is a diagrammatic side elevational view of an exemplary combined filter rod of four identical cigarette filters prior to cutting.
Figure 3:
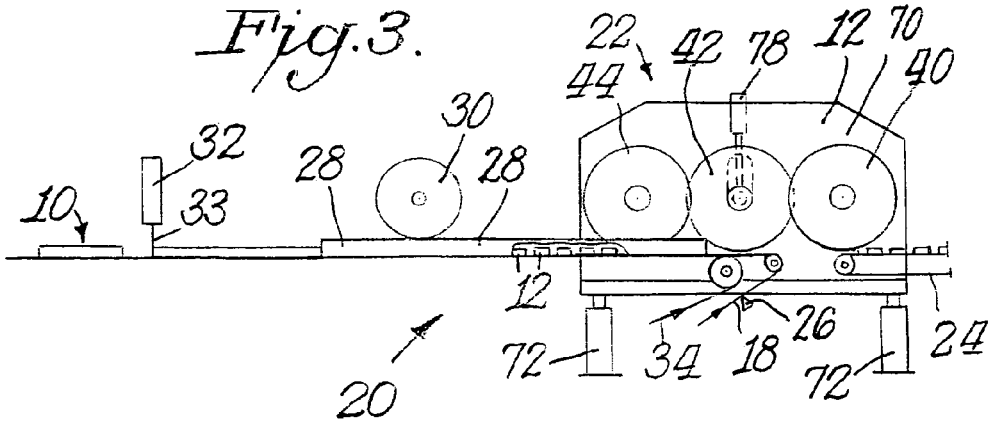
FIG. 3 is a schematic side elevational view of the apparatus for producing the combined filter rods of FIG. 1, according to the present invention.

Referring in more particularity to the drawings, FIG. 3 schematically illustrates apparatus 20 for continuously producing the filter rods 10 shown in FIG. 1. Fundamentally, filter segments 12 are delivered to a spacer wheel assembly 22 by a first endless belt conveyor 24. As explained more fully below, the spacer wheel assembly 22 receives filter segments 12 from the belt conveyor 24 and ultimately deposits the segments on the surface of endless plug wrap 18 to which adhesive has been applied by a glue applicator 26. The plug wrap 18 is drawn from a bobbin (not shown), and the filter segments 12 are placed onto the plug wrap 18 in precisely spaced apart relationship, as explained more fully below.

The plug wrap 22 is partially folded around the spaced apart filter segments 12 by a garniture 28 and granular material 16 is then deposited in the cavities 14 between the filter segments by a filling wheel 30. It is to be realized that the garniture 28 includes a portion underneath third wheel 44. At the nip of the third wheel 44, (the six-o'clock position on the third wheel 44) the garniture partially folds the plug wrap 18 about the plugs 12 delivered by the third wheel 14 to prevent relative movement thereof. Any known mechanism for depositing such granular material may be utilized such as the mechanism illustrated and described in U.S. Pat. No. 5,875,824, incorporated herein by reference. After completely filling the cavities, the plug wrap continues through the garniture 28 to be completely folded about the filter segments and the filled cavities. The continuous paper plug wrap 18 is drawn off its bobbin and transported downstream through and beyond the garniture 28 to a cutting head 32 by a second endless belt conveyor 34. At the cutting head 32 the continuous filter rod comprising filter segments with filled cavities therebetween is severed at regular intervals by rotating blade 33 to yield a succession of discrete combined filter rods 10 such s shown in FIG. 1.

Figure 6:
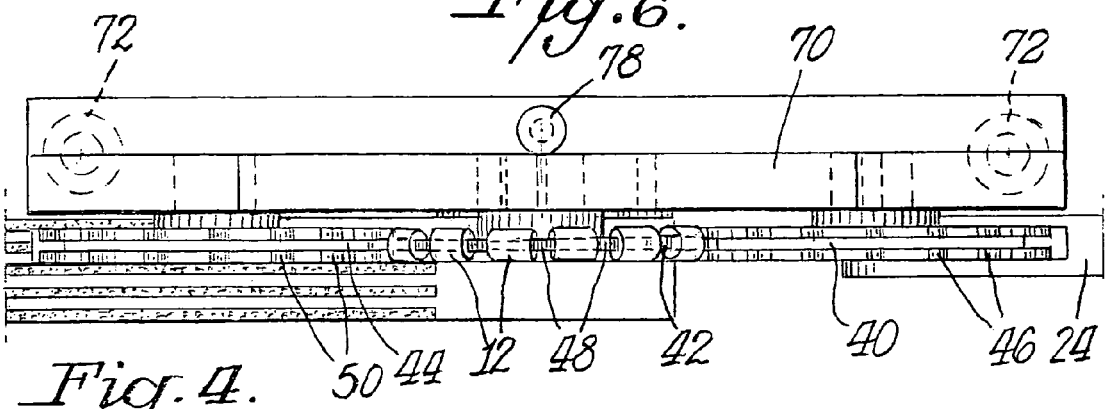
FIG. 6 is a top plan view of the spacer wheel assembly of FIG. 4, according to the present invention.
Figure 4:
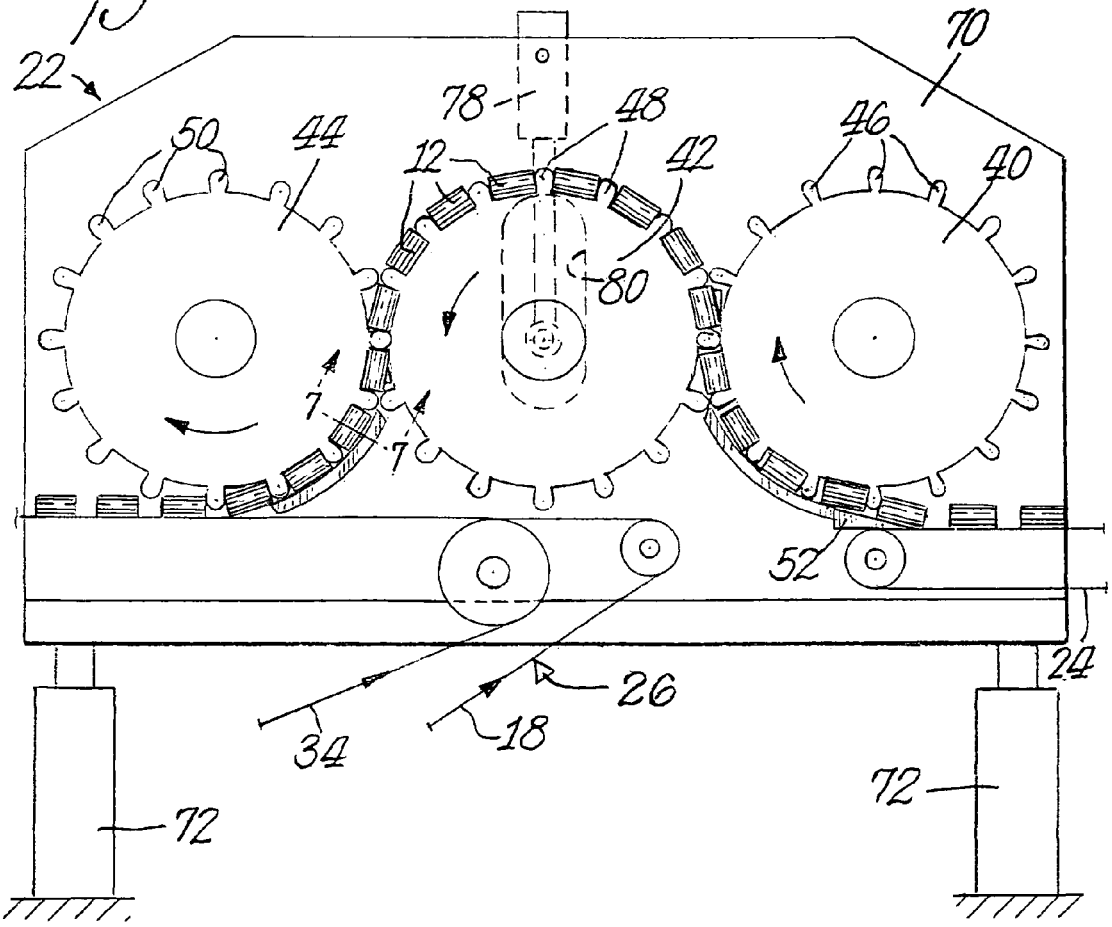
FIG. 4 is a side elevational view of the spacer wheel assembly for receiving individual filter segments and depositing the segments on plug wrap in precisely spaced apart relationship from one another.
Figure 5:
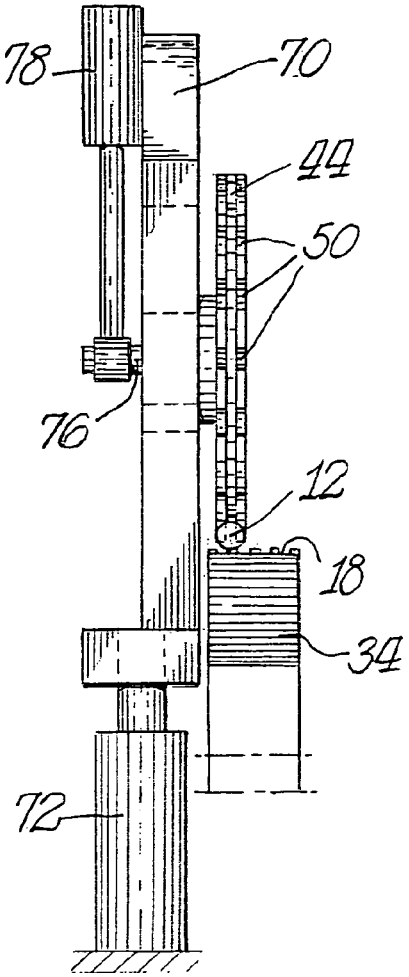
FIG. 5 is a left side elevational view of the spacer wheel assembly of FIG. 4, according to the present invention.

The spacer wheel assembly 22 is shown in more detail in FIGS. 4-6 and basically comprises three adjacent wheels 40, 42, 44 mounted for rotation about parallel axes, perpendicular to the direction of movement of the filter segments 12 on the first endless belt conveyor 24. The first wheel 40 functions to receive filter segments 12 from the first endless belt conveyor 24 while the second wheel 42 functions to transfer the filter segments from the first wheel to the third wheel 44. The second wheel also registers the segments as plugs are transferred from the first wheel 40 to the second wheel 42. The third wheel functions to deposit the filter segments onto the plug wrap 18 to which thin lines of adhesive have been applied by the glue applicator 26. The filter segments are deposited on the plug wrap in precisely spaced apart relationship to one another. Preferably, a servomotor and double sided timing belt drive (not shown) rotate the three wheels 40, 42, 44 at the same speed in the directions shown by the arrows in FIG. 4.

Preferably the wheels are driven such that the tangential speed of the third wheel 44 is essentially the same speed as the second endless belt conveyor 34 so that each filter segment 12 is delivered from the third wheel 44 at little or no relative speed with respect to belt conveyor 34. Jostling and slippage is therefore advantageously avoided. Moreover, the speed of the first continuous belt conveyor 24 is driven at a speed slightly greater than the tangential speed of the first wheel 40 at the nip defined therebetween, as explained more fully below.

Each wheel 40, 42, 44 of the spacer wheel assembly 22 has a plurality of spaced apart cleats 46, 48, 50 around the circumference thereof, and the spacing between the crowns of each adjacent pair of cleats on each wheel is the same. The breadth or accurate length of the cleats 48 and 50 on the second and third wheels, respectively, is the same and this cleat breadth matches the desired spacing between the filter segments 12 of the filter rod 10. The breadth of these cleats 48 and 50 precisely matches the length of each cavity 14 between adjacent filter segments of the filter rod. However, the breadth of the cleats 46 on the first wheel 40 is slightly reduced so as to create a greater amount of open spacing between adjacent cleats on the first wheel 40. This feature accommodates receipt of the filter segments 12 from the first endless belt conveyor 24 which is driven at a speed slightly greater than the tangential speed of the first wheel 40 at the nip defined therebetween. For example, with filter segments 10 mm in length the open spacing between adjacent cleats on the second and third wheels 42, 44 is also 10 mm. However, under such circumstances, the breadth of the cleats 46 on the first wheel 40 may be reduced 2 mm to thereby provide 12 mm of open space between the cleats 46 on the first wheel. Such 12 mm spacing readily accepts the 10 mm filter segments 12.

Figure 9:
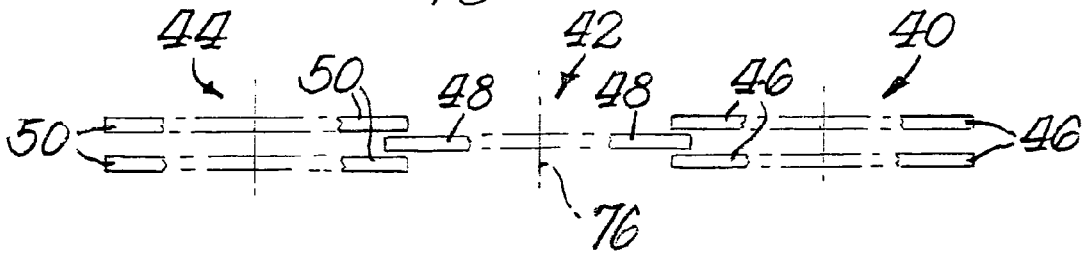
FIG. 9 is a diagrammatic view illustrating the intermeshing relationship of the cleats on the three wheels of the spacer wheel assembly.
Figure 7:
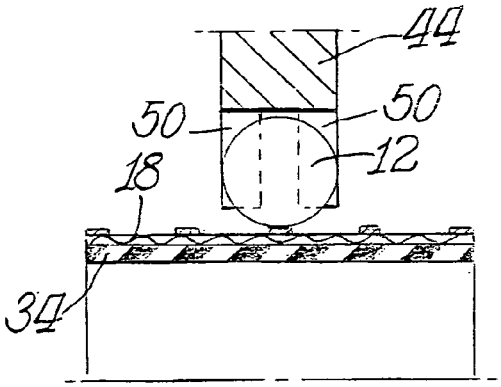
FIG. 7 is a cross-sectional view taken along line 7-7 of FIG. 4.

As shown best in FIGS. 5-7, the cleats 46, 50 on the first and third wheels 40, 44 of the spacer wheel assembly 22 comprise laterally spaced apart, side-by-side cleat pairs at each cleat location while the cleats 48 on the second or middle wheel each comprise a single cleat at each cleat location. The cleat arrangement is such that upon rotation of the wheels, the cleats 48 on the second or middle wheel 42 mesh with and pass between the side-by-side cleat arrangements on the first and third wheels 40, 44 as shown in FIG. 9. Accordingly, at the nip between each of the wheels 40, 42, 44 the cleats of adjacent wheels coincide as they are rotated through the nip. Moreover, the pairs of laterally spaced apart side-by-side cleats on the first and third wheels engage the ends of the filter segments as shown in FIG. 7 to thereby stabilize and transport the segment along a desired path of travel without sidewise movements. This is particularly important on the third wheel 44 where the filter segments 12 are precisely deposited on the adhesively coated plug wrap 18 and at the entrance to the first wheel 40.

In use, as the filter rod segments 12 are fed beneath the spacer wheel assembly 22 of the apparatus 20 of FIG. 3, cleats 46 on the first outer wheel 40 separate the filter rod segments 12 and one segment is received within the open spacing between adjacent cleats. As the first outer wheel 40 rotates the filter rod segments 12 held between the cleats 46 thereof are transported downstream towards the counter-rotating second or inner wheel 42. When the cleats 46 of the first outer wheel 40 interconnect with those of the inner wheel 42, the filter rod segments 14 held between them are transferred to between the cleats 48 of the inner wheel 42. Further rotation of the inner wheel 42 then transports the filter rod segments 12 transferred from the first outer wheel 40 further downstream towards the counter-rotating third wheel 44. As the cleats 50 of the third outer wheel 74 interlock with those of the second wheel 42, the filter rod segments 12 previously transferred from the first wheel 40 to the second wheel 42, which are held between the cleat of the second wheel 42, are transferred to between the cleats 50 of the third wheel 44. Further rotation of the third wheel 44 finally transfers the filter rod segments 12 onto the continuous running adhesively coated plug wrap 18. The plug wrap 18 is then partially folded around the filter rod segments 22 by garniture 28 and granular adsorbent 16 is filled into the cavities 14 between the spaced apart filter segments by filling wheel 30. Thereafter, the plug wrap 18 is totally folded around the filter segments and filled cavities by the garniture 28 and glued in place. The continuous rod is subsequently severed at regular intervals by the rotary knife 33 of the cutting head 32 to form discrete composite filter rods 10. In use, the rotation of each of the three wheels 40, 42, 44 of the spacer wheel assembly of the apparatus 20 is in phase with the cutting head 32, resulting in precise cuts of the continuous composite filter rod thereby producing the rods 10.

The apparatus 20 also may be used to produce either discrete recess filter rods, by driving the second endless belt conveyor 34 and the wheels 40, 42, 44 of the spacer wheel assembly 22 at the same speed to produce a continuous recess filter rod having air gaps of length equal to the width of the cleats 50 of the third wheel 44. In this version no granular material is filled into the cavities 14 and instead the cavities form the air gaps.

Also, discrete combined filter rods may be produced, by driving the second endless belt conveyor 34 at a reduced speed compared to the wheels 40, 42, 44 and delivering alternate filter segment to the spacer wheel assembly 22 to thereby produce a continuous combined filter rod, as desired.

Figure 2:
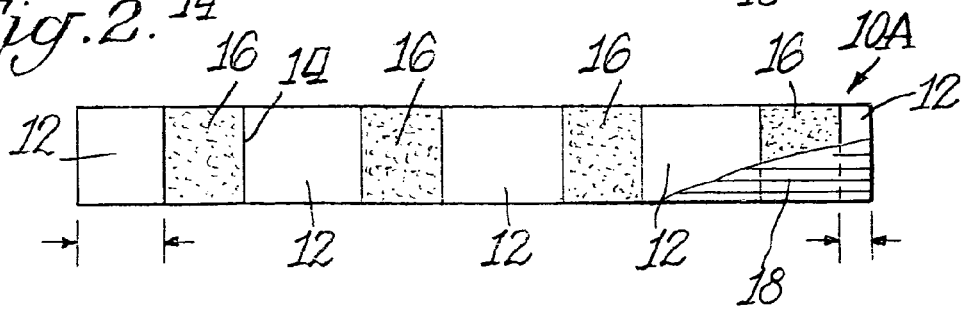
FIG. 2 is a diagrammatic view a combined filter rod similar to FIG. 1, but showing variation in the length of the outside filter rod segments caused by imprecise cutting of a continuous combined filter rod.

During transport of the filter segment 12 downstream towards the plug wrap 18 by the spacer wheel assembly 22, the filter segments are held in fixed relative position by the cleats 46, 48, 50 of the three wheels 40, 42, 44. The distance over which the filter segments 12 must then be transferred before they are fixed in position on the plug wrap 18 is greatly reduced compared to the distance of the filter segment travel in heretofore known apparatus. By reducing this distance and by using the spacer wheel assembly to perform the functions of known spiral spacer drums and transfer belts, the apparatus 20 of the present invention provides advantages over known apparatus in that the individual filter segments are stabilized by the cleats of the transfer wheels whereas in the prior art constructions the filter segments are free to move relative to one another. Such movement results in producing the off specification rods of the type shown in FIG. 2. In addition to these advantages, the apparatus 20 of the present invention also requires less maintenance compared to known apparatus since it does not include a transfer belt.

Once a filter segment 12 is established on the first transfer wheel 40 it becomes registered with respect to other segments upon transfer to the second wheel 42. Any shifting of the filter segment 12 at the nip between the first and second wheels is accommodated by the rounded shape of the cleats and by the intermeshing relationship of the cleats at the nip where cleats 48 on the second wheel pass between the spaced apart side-by-side cleats 46 on the first wheel 40.

Figure 8:
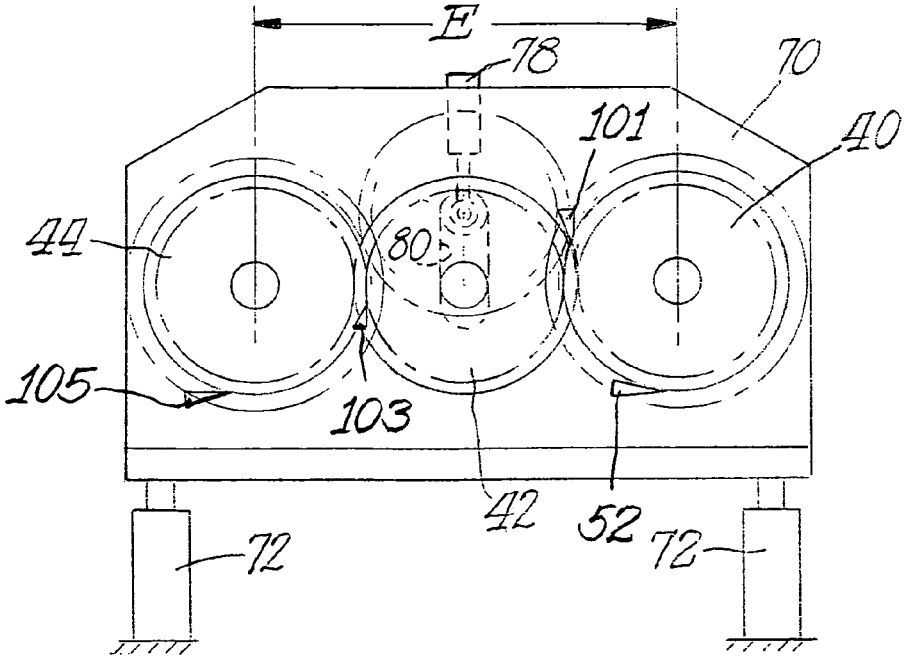
FIG. 8 is a diagrammatic view similar to FIG. 4, but illustrating a different spacer wheel assembly mounted on the same frame as shown in FIGS. 4-6.

Referring to FIG. 8, the apparatus 20 includes a first plow 52 at the 6 o'clock position of the first wheel 40 to strip plugs from the first belt 24 and the point of transfer onto the first wheel 40. The apparatus 20 further includes a plow 101 at the transfer point between the first and second wheels 40 and 42, another plow 103 at the transfer point between the second and third wheels 42 and 44 and another plow 105 at the transfer point from the third wheel 44 and the garniture 28.

A framework 70 is provided to support the three transfer wheels 40, 42, 44 of the spacer wheel assembly 22. The axes of the three wheels are supported in cantilever fashion by the framework 70. The framework in turn is supported by numatic piston and cylinder devices 72 whereby the framework with the wheels connected thereto may be raised and lowered relative to the first and second belt conveyors 24 and 34, respectively. Raising and lowering the framework facilitates cleaning underneath the wheels as well as precisely locating the circumferences of the first and third wheels relative to the belt conveyors.

Depending upon the particular filter rod 10 being produced, different sets of wheels may be used having different diameters and different cleat arrangements. FIG. 8 shows a set of different wheels in phantom outline. Regardless of which set of wheels is selected the first and third wheels always have equal diameters and the first and third wheels are always mounted on the same axis since the nip between the first wheel and the belt conveyor 24 is always at the same location regardless of the diameter of the first wheel. Similarly, the nip between the third wheel and the second belt conveyor 24 is always the same. Hence, the distance E is a fixed dimension.

The axis of rotation 76 of the second wheel is adjustable in the vertical direction in order to properly orient the second wheel relative to the first and third wheels. When the first and third wheels have an increased diameter, the axis of rotation 74 for the second wheel must be elevated slightly and the converse is true when the first and second wheels have a decreased diameter. Adjusting the axis of rotation 74 of the second wheel is accomplished by raising and lowering the rotational shaft 76 of the second wheel with a piston and cylinder device 78. The shaft 76 is free to move in a vertically oriented slot 80 in the framework 70.

We claim:

1. A method for producing filter rods comprising the steps of:

conveying discrete filter segments in end-to-end fashion with spacing therebetween in a downstream direction;

transferring the filter segments to the circumference of a first transfer wheel with one segment between an adjacent pair of cleats on the first wheel;

transferring the filter segments on the first wheel to the circumference of a second transfer wheel with one segment between an adjacent pair of cleats on the second wheel;

transferring the filter segment on the second wheel to the circumference of a third transfer wheel with one segment between an adjacent pair of cleats on the third wheel; and wherein the cleats on the second and third wheels are equally spaced apart and define an open space between adjacent cleats equal to the given length of the discrete filter segments;

directly depositing the filter segments from the third wheel onto plug wrap with the segments equally spaced apart on the plug wrap.

2. A method as in claim 1 wherein the spaced apart filter segments on the plug wrap define cavities therebetween, and the method further includes the step of filling the cavities with granular adsorbent material.

3. A method as in claim 2 further including the step of folding the plug wrap around the spaced apart filter segments and the filled cavities therebetween.

4. Apparatus for producing filter rods comprising:

a first conveyor for conveying discrete filter segments of given length and opposite ends in a downstream direction in end-to-end fashion with spacing therebetween;

a first rotatable transfer wheel constructed and arranged to define a nip with the first conveyor with spaced apart cleats on the circumference thereof for receiving individual filter segments in end-to-end fashion with spacing therebetween from the first conveyor between adjacent cleats of the first wheel with opposite ends of the segments next to adjacent cleats;

a second rotatable transfer wheel constructed and arranged to define a nip with the first wheel with spaced apart cleats on the circumference thereof for receiving individual filter segments in end-to-end fashion with spacing therebetween from the first wheel between adjacent cleats on the second wheel with opposite ends of the segments next to adjacent cleats;

a third rotatable transfer wheel constructed and arranged to define a nip with the second wheel with spaced apart cleats on the circumference thereof for receiving individual filter segments in end-to-end fashion with spacing therebetween from the second wheel between adjacent cleats on the third wheel with opposite ends of the segments next to adjacent cleats; and a second conveyor with plug wrap thereon constructed and arranged to define a nip with the third wheel for receiving spaced apart filter segments from the third wheel;

and wherein the cleats on the second and third wheels are equally spaced apart and define an open space between adjacent cleats equal to the given length of the discrete filter segments.

5. Apparatus as in claim 1 wherein each of cleats on the second and third wheels has a breadth equal to the spacing between adjacent filter segments on the plug wrap.

6. Apparatus as in claim 5 wherein the cleats on the first wheel are equally spaced apart and define an open space between adjacent cleats slightly greater than the given length of the discrete filter segments.

7. Apparatus as in claim 4 wherein the cleats on the first and third wheels comprise laterally spaced side-by-side cleats at each cleat location on the circumferences thereof, and wherein the cleats on the second wheel comprise single cleats at each cleat location constructed and arranged to pass through the side-by-side cleats on the first and third wheels at the nips between the first and second wheels and the second and third wheels.

8. Apparatus as in claim 4 further comprising:

a framework mounting the first, second and third wheels;

means for moving the framework in a vertical direction for adjusting the position of the first and third wheels relative to first and second conveyors; and adjusting means on the framework for vertically moving the second wheel relative to the first and third wheels.

9. Apparatus as in claim 4 wherein the spaced apart filter segments received onto the plug wrap define cavities therebetween, and the apparatus further includes filling means for filling granular adsorbent material into the cavities.

10. Apparatus as in claim 9 further including a garniture for folding the plug wrap around the filter segments and the filled cavities therebetween.

11. A set of transfer wheels for delivering filter segments in a downstream direction comprising:

a first rotatable transfer wheel having a plurality of spaced apart cleats on the circumference thereof for receiving filter segments between the cleats;

a second rotatable transfer wheel having a plurality of spaced apart cleats on the circumference thereof for receiving filter segments from the first wheel between the cleats on the second wheel;

a third rotatable transfer wheel having a plurality of spaced apart cleats on the circumference thereof for receiving filter segments from the second wheel between the cleats on the third wheel; and wherein the cleats on the first and third wheels comprise laterally spaced apart side-by-side cleats at each cleat location on the circumferences thereof, and wherein the cleats on the second wheel comprise single cleats at each cleat location constructed and arranged to pass through and between the side-by-side cleats on the first and third wheels at the nips between the first and second wheels and the second and third wheels; and wherein the cleats on the second and third wheels are equally spaced apart and define an open space between adjacent cleats equal to the given length of the discrete filter segments.

* * * * *

UNITED STATES PATENT AND TRADEMARK OFFICE

CERTIFICATE OF CORRECTION

PATENT NO. : 8,337,374 B2
APPLICATION NO. : 11/156276
DATED : December 25, 2012
INVENTOR(S) : Martin T. Garthaffner et al.

It is certified that error appears in the above-identified patent and that said Letters Patent is hereby corrected as shown below:

At column 8, claim 5, line 26, "Apparatus as in claim 1 wherein each of cleats on the" should read --Apparatus as in claim 4 wherein each of cleats on the--

Signed and Sealed this
Nineteenth Day of February, 2013

Teresa Stanek Rea
*Acting Director of the United States Patent and Trademark Office*